US010022952B1

(12) United States Patent
Levy et al.

(10) Patent No.: US 10,022,952 B1
(45) Date of Patent: Jul. 17, 2018

(54) MASK SCREEN FOR UV CURING

(71) Applicant: Xerox Corporation, Norwalk, CT (US)

(72) Inventors: Michael Jon Levy, Webster, NY (US); Douglas K. Herrmann, Webster, NY (US); Paul McConville, Webster, NY (US); Jason Matthew LeFevre, Penfield, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/473,293

(22) Filed: Mar. 29, 2017

(51) Int. Cl.

| | |
|---|---|
| ***B41J 3/407*** | (2006.01) |
| ***B41F 15/08*** | (2006.01) |
| ***B41F 15/36*** | (2006.01) |
| ***B41F 17/28*** | (2006.01) |
| ***B41F 23/04*** | (2006.01) |
| ***B41J 11/00*** | (2006.01) |
| ***B41J 2/045*** | (2006.01) |

(52) U.S. Cl.
CPC ..... *B41F 15/0895* (2013.01); *B41F 15/36* (2013.01); *B41F 17/28* (2013.01); *B41F 23/04* (2013.01); *B41J 2/04501* (2013.01); *B41J 3/4073* (2013.01); *B41J 11/002* (2013.01)

(58) Field of Classification Search
CPC ..... B41J 3/4073; B41J 2/04501; B41J 11/002
USPC ..... 347/4; 250/515.1, 519.1
See application file for complete search history.

(56) References Cited

U.S. PATENT DOCUMENTS

| | | | | |
|---|---|---|---|---|
| 7,300,129 | B2 * | 11/2007 | Kumamoto | B41J 11/002 347/102 |
| 7,766,473 | B2 * | 8/2010 | Hoshino | B41J 11/002 347/102 |
| 2003/0151656 | A1 * | 8/2003 | Kokubo | B41J 2/32 347/175 |
| 2009/0207203 | A1 * | 8/2009 | Yamamoto | B41J 11/002 347/16 |
| 2013/0044172 | A1 * | 2/2013 | Nakajima | B41J 11/002 347/102 |
| 2014/0002557 | A1 * | 1/2014 | Condello | B41J 11/002 347/102 |
| 2015/0231897 | A1 * | 8/2015 | Noell | B41J 3/4073 347/102 |
| 2017/0341414 | A1 | 11/2017 | Buchar et al. | |

* cited by examiner

*Primary Examiner* — Leslie J Evanisko

(57) ABSTRACT

A print system and a method for curing marking material on an object using a mask screen are disclosed. For example, the print system includes a plurality of printheads, a curing light source, a movable member to hold an object, a mask screen and a controller to control movement of the movable member to move the object past the array of printheads, to operate the plurality of printheads to eject the marking material onto the object as the object passes the two-dimensional array of printheads, to control movement of the movable member to catch the mask screen and to operate the curing light source to cure the marking material, wherein the amount of energy that is applied to the object is controlled by the mask screen.

17 Claims, 5 Drawing Sheets

MASK SCREEN FOR UV CURING

The present disclosure relates generally to curing systems and, more particularly, to a mask screen for UV curing in a three dimensional (3D) object printer and methods for using the same.

BACKGROUND

Some printers use UV curable inks to print on articles and objects. UV curable inks are applied onto the article or object and a UV light source is used to cure the ink. The UV light source may be used to initiate a photochemical reaction that generates a crosslinked network of polymers. In other words, the ink is not simply "dried" where solvent is evaporated from the ink. Rather, the UV ink is cured such that the polymers in the UV ink undergo a chemical reaction to link or bond to the article or object.

A curing light source may be used to apply light to cure the UV curable ink. However, if the curing light source does not emit the proper amount of light, the UV curable ink may not completely cure. Uncured UV inks may emit some volatile organic compounds (VOCs). VOCs are considered to have a negative impact on the environment and the end user. Furthermore, if the UV ink is not completely cured, the UV ink that is printed onto the article or object may be wiped off.

Three dimensional objects have varying slopes, angles and curvatures that do not provide a flat and even surface for curing. As a result, different portions of the three dimensional object may be different distances away from the curing light source. The different distances may cause the curing light source to cure the UV curable ink on the three dimensional object at different rates. Thus, the UV curable ink may not be properly cured on different surfaces of the three dimensional object.

SUMMARY

According to aspects illustrated herein, there are provided a print system and a method for curing marking material on an object using a mask screen. One disclosed feature of the embodiments is a print system that comprises a plurality of printheads arranged in a two-dimensional array, wherein each one of the plurality of printheads is configured to eject a marking material, a curing light source coupled to the two-dimensional array of the plurality of printheads, a movable member to hold an object, wherein the movable member is positioned parallel to a plane formed by the two-dimensional array of the plurality of printheads and the curing light source, a mask screen positioned parallel to the plane, wherein the mask screen is located between the movable member and the curing light source and a controller to control movement of the movable member to move the object past the array of printheads, to operate the plurality of printheads to eject the marking material onto the object as the object passes the two-dimensional array of printheads, to control movement of the movable member to catch the mask screen and to operate the curing light source to cure the marking material, wherein the amount of energy that is applied to the object is controlled by the mask screen.

Another disclosed feature of the embodiments is a method for curing marking material on an object using a mask screen. In one embodiment, the method comprises ejecting the marking material onto the object via a two-dimensional array of a plurality of printheads, moving a movable member holding the object vertically parallel to a plane formed by the two-dimensional array of the plurality of printheads, catching the mask screen via a tab member on the mask screen and a corresponding tab member on the movable member as the movable member is moving vertically towards a curing light source and curing the marking material on the object via the curing light source, wherein the amount of light for curing the marking material on different locations of a surface of the object is controlled by the mask screen.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses an apparatus and method for curing marking material on an object using a mask screen. As discussed above, some printers use UV curable inks to print on articles and objects. UV curable inks are applied onto the article or object and a UV light source is used to cure the ink. The UV light source may be used to initiate a photochemical reaction that generates a crosslinked network of polymers. In other words, the ink is not simply "dried" where solvent is evaporated from the ink. Rather, the UV ink is cured such that the polymers in the UV ink undergo a chemical reaction to link or bond to the article or object.

A curing light source may be used to applying light to cure the UV curable ink. However, if curing light source malfunctions or does not emit the proper amount of light, the UV curable ink may not completely cure. Uncured UV inks may emit some volatile organic compounds (VOCs). VOCs are considered to have a negative impact on the environment and the end user. Furthermore, if the UV ink is not completely cured, the UV ink that is printed onto the article or object may be wiped off.

Three dimensional objects have varying slopes, angles and curvatures that do not provide a flat and even surface for curing. As a result, different portions of the three dimensional object may be different distances away from the curing light source. The different distances may cause the curing light source to cure the UV curable ink on the three dimensional object at different rates. Thus, the UV curable ink may not be properly cured on different surfaces of the three dimensional object.

Embodiments of the present disclosure provide a novel apparatus and method that control the amount of light from a curing light source that contacts a surface of an object to cure marking material on the surface of the object. For example, marking material that is on surfaces that are closer to the curing light source may require less light to cure than marking material that is on surfaces that are father away from the curing light source. The embodiments of the present disclosure provide a screen mask that can be used in the 3D object printer that may control the amount of light that reaches surfaces of the object that are at different distances away from the curing light source. As a result, the embodiments of the present disclosure provide more control of the curing process and more consistent curing over all surfaces of the object that have the marking material.

Figure 1:
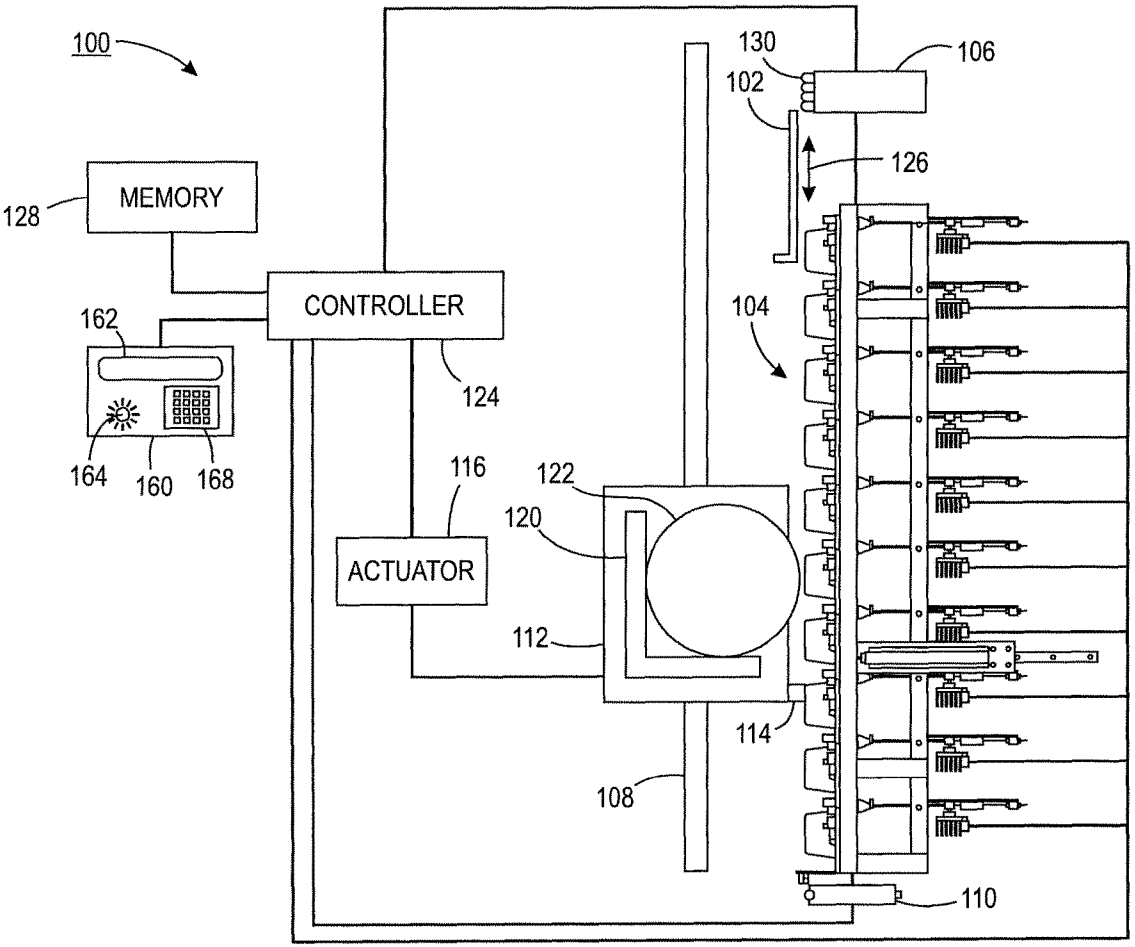
FIG. 1 illustrates an example 3D object printer of the present disclosure.

FIG. 1 illustrates an exemplary printing system 100 configured to print on an object 122. The object 122 may be a three dimensional (3D) object that has an irregular shape. For example, the object 122 may have one or more different curved surfaces with different amounts of curvature. Said another way, the object 122 may not have a flat surface.

In one embodiment, the printing system 100 includes an array, or a plurality, of printheads 104, a support member 108, a member 112 movably mounted to the support member 108, an actuator 116 operatively connected to the movably mounted member 112, an object holder 120 configured to mount to the movably mounted member 112 and a controller 124 operatively connected to the plurality of printheads and the actuator. As shown in FIG. 1, the array of printheads 104 is arranged in a two-dimensional array, which in the figure is a 10×1 array, although other array configurations can be used. Each printhead is fluidly connected to a supply of marking material (not shown) and is configured to eject marking material received from the supply. Some of the printheads can be connected to the same supply or each printhead can be connected to its own supply so each printhead can eject a different marking material.

In one embodiment, the marking material may be an ultra violet (UV) ink. The marking material may be cured by a curing light source 106. The curing light source 106 may be positioned to cure the marking material after the marking material is ejected by the array of printheads 104. For example, the curing light source 106 may be positioned vertically above or below the array of printheads 104 depending on which direction printing occurs along the support member 108. Said another way, the curing light source 106 may be stacked above or below the array of printheads 104 along a plane formed by the array of printheads 104.

In one embodiment, the controller 124 may also be operatively coupled to the curing light source 106 to control an amount and a duration of light applied to the marking material for curing. In other words, the curing light source 106 may be used to initiate a photochemical reaction that generates a crosslinked network of polymers. In other words, the ink is not simply "dried" where solvent is evaporated from the ink. Rather, the marking material (e.g., the UV ink) is cured such that the polymers in the marking material undergo a chemical reaction to link or bond to the object 122.

In one embodiment, the curing light source 106 may include a two dimensional array of light emitting diodes (LEDs) 130. The LEDs 130 may be UV emitting LEDs that can cure the marking material. Each one of the LEDs 130 may be independently addressable. In other words, the luminosity or light intensity of each LED 130 within the two dimensional array of LEDs 130 may be controlled independent of the other LEDs 130.

In one embodiment, the print system may include a mask screen 102 that is located between the movably mounted member 112 and the curing light source 106. The mask screen 102 may be located between the object 122 and the curing light source 130 such that light emitted from the LEDs 130 may go through the mask screen 102 and then contact the surface of the object 122.

In one embodiment, the mask screen 102 may include a tab member 116. The movably mounted member 112 may include a corresponding tab member 114. The tab member 116 and the corresponding tab member 114 may comprises a plastic or a metal that is coupled to the mask screen 102 and the movably mounted member 112, respectively. In another embodiment, the tab member 116 and the corresponding tab member 114 may be molded or fabricated as a continuous single piece of material that is part of the mask screen 102 and the movably mounted member 112.

In one embodiment, after the marking material is ejected onto the object 122, the actuator 116 may move the movably mounted member 112 vertically along the support member 108 towards the curing light source 106. As the movably mounted member 112 is moving, the corresponding tab member 114 may catch the tab member 116. The mask screen 102 may then move vertically up the support member 108 (e.g., as shown by an arrow 126) towards the curing light source 106 while remaining in front of the object 122.

After the marking material is cured on the object 122, the movably mounted member 112 may move vertically down the support member 108 away from the curing light source 106. The mask screen 102 may "fall" with the movably mounted member 112 until it returns to a default position (as discussed in further detail below with respect to FIGS. 2 and 3). The movably mounted member 112 may continue to move down the support member 108 and the mask screen 102 may remain in the default position above the array of printheads 104 and below the curing light source 106. As a result, the mask screen 102 does not interfere with the ejection of the marking material from the array of printheads 104.

In one embodiment, "catch" may be defined as having the corresponding tab member 114 contact the tab member 116. In other words, the corresponding tab member 114 may have enough surface area and stiffness, or rigidiy, to push the tab member 116 upwards with the mask screen 102 as the movably mounted member 112 is moved by the actuator 116. In another embodiment, "catch" may be defined to include a mating connection (e.g., via a magnet or mechanical means). For example, the corresponding tab member 114 and the tab member 116 may be magnetized or may have mechanical features (e.g., a protrusion that mates with a corresponding opening, and the like).

In one embodiment, the screen mask 102 may be customized for each different type of object 122. In other words, the screen mask 102 may be fabricated in advance. Based on the object 122 that is inserted into the printing system 100, the corresponding screen mask 102 may also be inserted into the printing system 100.

In one embodiment, the printing system 100 may include an optical sensor 110. The optical sensor 110 may be a scanner to scan a stock keeping unit (SKU), a barcode, or any other machine readable mark on the object 122. The SKU may provide information to the controller 124 with regards to which screen mask 102 should be inserted into the printing system 100. In one embodiment, the screen mask 102 may also have a SKU. The printing system 100 may require the SKU of the screen mask 102 to be scanned by the optical sensor 110 before the printing process may begin. The controller 124 may ensure that the proper screen mask 102 has been inserted by comparing the SKU of the screen mask 102 matches the SKU of the object 122.

In one embodiment, the controller 124 may also be operatively coupled to an interface 160. The interface 160 may include a display 162, an annunciator 164 and an input device 168, such as a keypad. The interface 160 may be used to notify an operator of the screen mask 102 that should be inserted into the printing system 100. In one embodiment, the SKU of the screen mask 102 may be entered by an operator via the input device 168 of the interface 160 instead of being scanned by the optical sensor 110.

Figure 2:
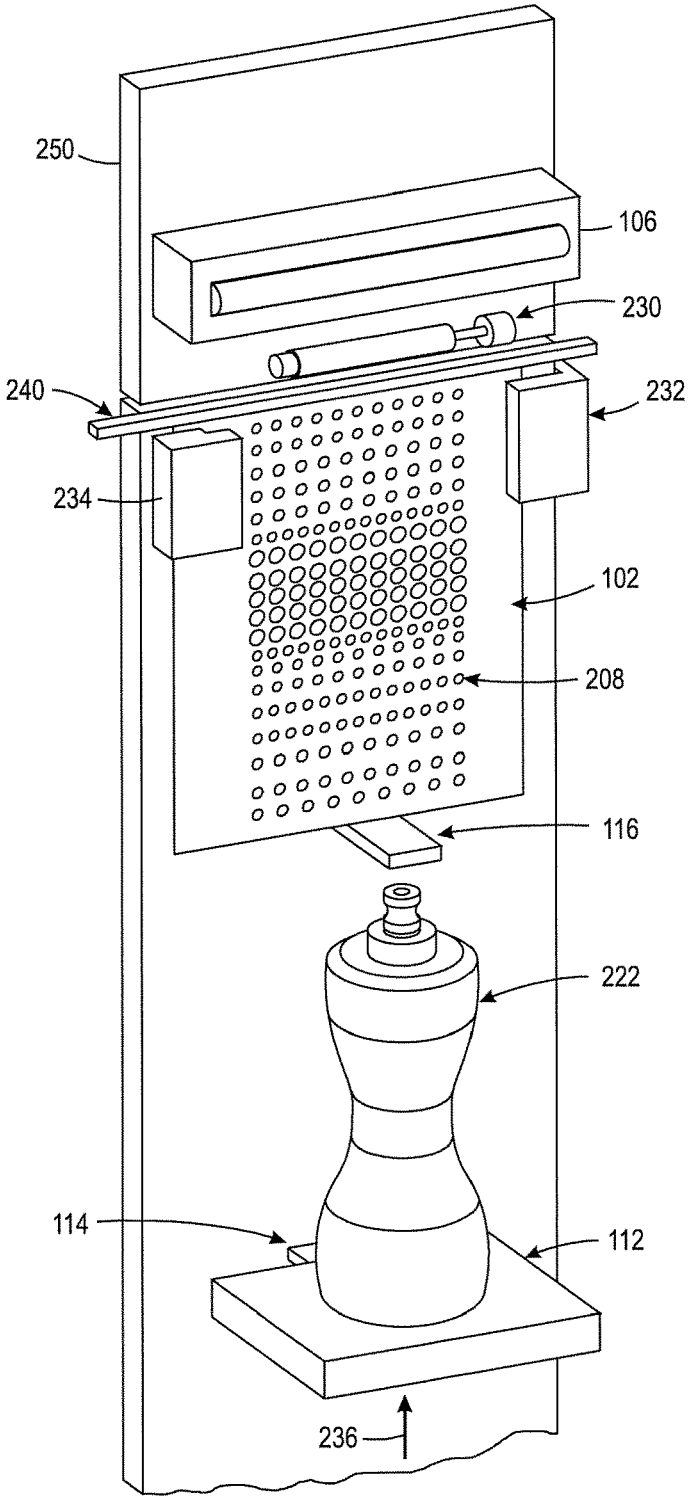
FIG. 2 illustrates a detailed block diagram of a mask screen.

FIG. 2 illustrates a further detailed block diagrams of the mask screen 102. In one embodiment, the mask screen 102 may be positioned between a right guide member 232 and a left guide member 234. In one embodiment, the right guide member 232 and the left guide member 234 may be mounted on brackets to a frame 250 that the curing light source 106 and the array of printheads 104 are also mounted to. In another embodiment, the frame 250 may be located between the movably mounted member 112 and the curing light source 106.

In one embodiment, the mask screen 102 may move freely between the right guide member 232 and the left guide member 234. In one embodiment, a stopping member 240 may be coupled to the mask screen 102. The stopping member 240 may have a width that is wider than the width of the mask screen 102. The width of the stopping member 240 may also be wider than a distance between the right guide member 232 and the left guide member 234. As a result, the stopping member 240 may rest on top of the right guide member 232 and the left guide member 234, as shown in FIG. 2. The default position, or return position, of the mask screen 102 discussed above, may be when the stopping member 240 is resting on top of the right guide member 232 and the left guide member 234.

In one embodiment, the printing system 100 may also include a mask screen vibrator 230. The mask screen vibrator 230 may also be coupled to the frame 250 or the mask screen 102. The mask screen vibrator 230 may contact the mask screen 102 to shake the mask screen 102 from left to right, as discussed below with respect to FIG. 3.

In one embodiment, the mask screen 102 may include a plurality of light control areas 208. The light control areas 208 may control the amount of light that contacts a surface of an object 222 that has marking material. As discussed above, 3D objects have varying slopes, angles and curvatures that do not provide a flat and even surface for curing. As a result, different portions of the object 222 may be different distances away from the curing light source 106. The different distances may cause the curing light source 106 to cure the marking material, or UV curable ink, on the object 222 at different rates. Thus, the marking material may not be properly cured on different surfaces of the object 222.

In one embodiment, the mask screen 102 may be sheet metal. The light control areas 208 may be holes or openings that are cut through the sheet metal. In one embodiment, the holes may have different diameters or areas. The diameter of the holes may be a function of a distance of a surface of the object 222 from the curing light source 106. For example, surfaces that are further away from the curing light source 106 may have larger diameter openings. Surfaces that are closer to the curing light source 106 may have smaller diameter openings. In one embodiment, the pattern of the openings may be cut into the sheet metal to be similar to an outline of the object 222.

In another embodiment, the mask screen 102 may be a glass or optically clear material that can withstand the heat of the curing light source 106. The light control areas 208 may have different levels of opaqueness in different locations of the mask screen 102 to control the amount of light that contacts the surfaces of the object 222. All areas without a light control area 108 may be completely opaque to prevent light from pass through. In one embodiment, the level of opaqueness of a light control area 208 may be a function of a distance of the surface of the object 222 from the curing light source 106. For example, surfaces that are further away from the curing light source 106 may have less opaqueness or be more optically clear to allow more light to pass through. Surfaces that are closer to the curing light source 106 may have more opaqueness or be less optically clear to prevent a certain amount of light to pass through.

It should be noted that although the light control areas 208 are illustrated in FIG. 2 as being circular, it should be noted that the light control areas 208 may be any geometry. In addition, they light control areas 208 may have different geometries to further control the amount of light that passes through the mask screen 102.

Figure 3:
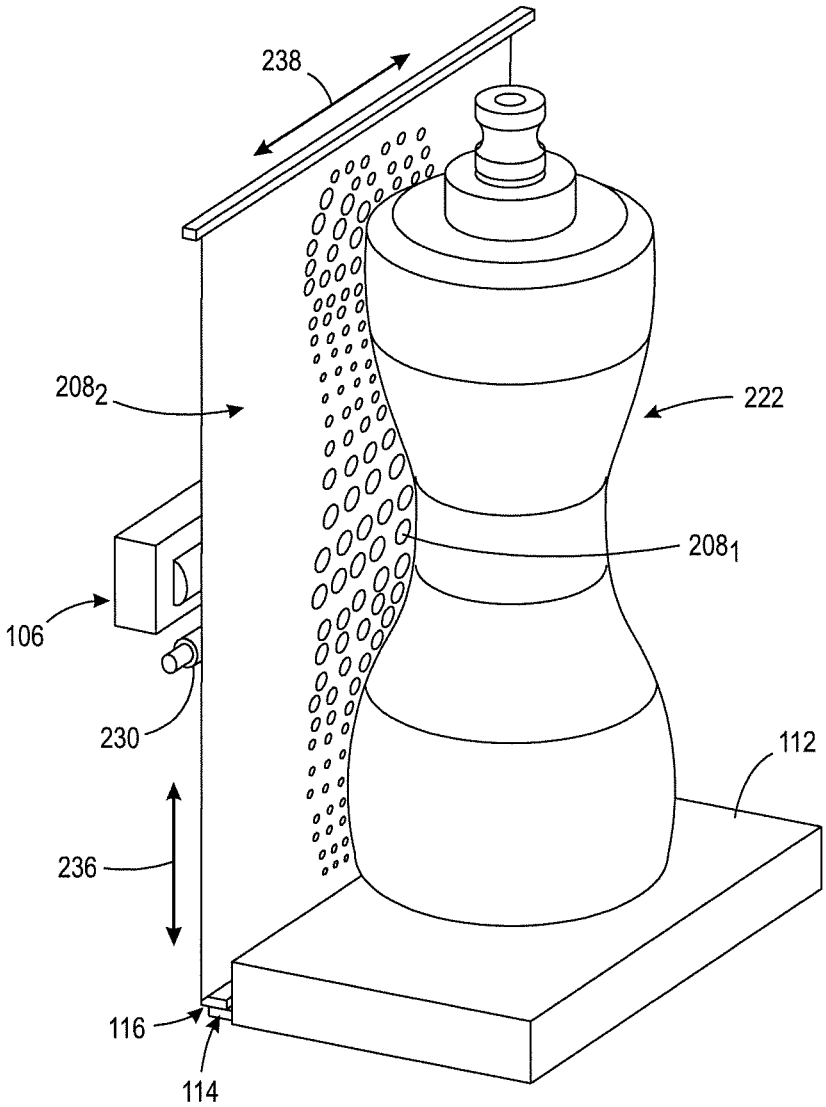
FIG. 3 illustrates a detailed block diagram of the mask screen moving with an object past a curing light source.

FIG. 3 illustrates a detailed block diagram of the mask screen 102 moving with the object 222 past the curing light source 106. As noted above, the corresponding tab member 114 may catch the tab member 116 and move the mask screen 102 upwards simultaneously and aligned with the object 222. In other words, the light control areas 108 are aligned with appropriate surfaces of the object 222 to control the amount of light that reaches the surfaces to cure the marking material ejected onto the surfaces.

As illustrated in FIG. 3, surfaces of the object 222 that are further away from the curing light source 106 may have a light control area $\mathbf{208}_1$ that allows more light to pass through (e.g., a larger opening or less opaqueness) than the light control area $\mathbf{208}_2$ that correspond to surfaces that are closer to the curing light source 106. FIG. 3 also illustrates how the pattern of the light control areas 208 follows an outline or a silhouette of the object 222.

As noted above, the printing system 100 may also include the mask screen vibrator 230. The mask screen vibrator 230 may shake or vibrate the masks scree 102 horizontally, or from left to right, as shown by an arrow 238 as the mask screen 102 and the object 222 move vertically up and down the support member 108. Vibrating the mask screen 102 may ensure that the marking material is evenly and completely cured. For example, without the vibration, certain surfaces behind the small areas of the mask screen 102 without a light control area 208 may be blocked from receiving any light from the curing light source 106. Thus, the vibration allows the light control areas 208 to move quickly from side to side to allow marking material on all surfaces of the object 222 to be evenly and completely cured.

After the marking material on the object 222 is completely cured, the movably mounted member 112 may move vertically downward along the support member 108. The stopping member 240 may rest against the right guide member 232 and the left guide member 234 to return the mask screen 102 to the default position shown in FIG. 2. The movably mounted member 112 may continue to move downward into a resting position to allow the object 222 to be removed from the printing system 100.

Referring back to FIG. 1, in one embodiment, the support member 108 is positioned to be parallel to the plane formed by the array of printheads and, as shown in FIG. 1, is oriented so one end of the support member 108 is at a higher gravitational potential than the other end of the support member 108. This orientation enables the printing system 100 to have a smaller footprint than an alternative embodiment that horizontally orients the two-dimensional array of printheads and configures the support member, the member, and the object holder to enable the object holder to pass objects past the horizontally arranged printheads so the printheads can eject marking material downwardly on the objects.

The member 112 is movably mounted to the support member 108 to enable the member to slide along the support member 108. In some embodiments, the member 112 can move bi-directionally along the support member 108. In other embodiments, the support member 108 is configured to provide a return path to the lower end of the support member 108 to form a track for the member 112. The actuator 116 is operatively connected to the member 112 so that the actuator 116 can move the member 112 along the support member 108 and enable the object holder 120 connected to the member 112 to pass the two-dimensional array of the plurality of printheads 104 in one dimension of the two-dimensional array of printheads 104.

In the embodiment, the object holder 120 moves the object 122 along a length dimension of the array of printheads 104. The object holder 120 may have different shapes and sizes depending on a shape and size of the object 122. For example, different object holders 120 may be coupled to the member 112 for different objects 122. The object holder 120 may be custom built for each different type of object 122 that is used in the printing system 100.

As noted above, the printing system 100 may include the optical sensor 110. The optical sensor 110 may scan the SKU on the object 122 to provide additional information to the controller 124. For example, the SKU may also provide information such as how to control the array of printheads 104 to print an image onto the surface of the object 122. For example, different shaped objects 122 may have different printing profiles that may be included into the SKU.

In one embodiment, the optical sensor 110 may be a scanner that can scan the object 122 to determine a profile of the object 122. For example, the printing system 100 may determine a printing profile on-the-fly using the optical sensor 110. The surface profile scanned by the optical sensor 110 may be transmitted to the controller 124. The controller 124 may then calculate a sequence of operation of the printheads of the array of printheads 104 and an amount of marking material to eject from each printhead.

In one embodiment, the controller 124 is configured with programmed instructions stored in a memory 128 operatively connected to the controller so the controller can execute the programmed instructions to operate components in the printing system 100. Thus, the controller 124 is configured to operate the actuator 116 to move the object holder 120 past the array of printheads 104 and to operate the array of printheads 104 to eject marking material onto the object 122 held by the object holder 120 as the object holder 120 passes the array of printheads 104.

In one embodiment, the interface 160 may also be used to notify an operator if a printing program for a particular SKU is not available, display error messages, completion messages, and the like, on the display 162. The annunciator 164 may provide a warning light or an audible alarm to attract attention to messages on the display 162 or to indicate an error has occurred.

Additionally, the controller 124 is configured to operate the inkjets within the printheads of the array of printheads 104 so they eject drops with larger masses than the masses of drops ejected from such printheads. In one embodiment, the controller 124 operates the inkjets in the printheads of the array of printheads 104 with firing signal waveforms that enable the inkjets to eject drops that produce drops on surfaces of the object 122 having a diameter of about seven to about ten millimeters (mm). This drop size is appreciably larger than the drops that produced drops on the material receiving surface having a mass of about 21 nanograms (ng).

It should be noted that the orientation of the components of the printing system 100 is provided as an example. For example, FIG. 1 illustrates the printing process moved vertically upwards from the bottom of the page towards the top of the page. However, it should be noted that the components may be flipped such that the printing process may move vertically downwards from the top of the page to the bottom of the page.

The system configuration shown in FIG. 1 is especially advantageous in a number of aspects. For one, as noted above, the vertical configuration of the array of printheads 104 and the support member 108 enables the printing system 100 to have a smaller footprint than a system configured with a horizontal orientation of the array and support member. This smaller footprint of the printing system 100 enables the printing system 100 to be housed in a single cabinet and installed in non-production outlets. Once installed, various object holders can be used with the system to print a variety of goods that are generic in appearance until printed.

Another advantageous aspect of the printing system 100 shown in FIG. 1 is the gap presented between the objects 122 carried by the object holder 120 and the printheads of the array of printheads 104. The gap in this embodiment is in a range of about five to about six mm. Heretofore, the gap was maintained in a range centered about 1 mm. This smaller gap was thought to ensure a more accurate placement of drops from an ejecting printhead. It has been discovered that the greater gap width reduces the effect of laminar air flow in the gap between the printheads and the surface receiving the marking material drops so the accuracy of drop placement, especially for larger 3D objects, is maintained. This effect is particularly effective with the larger drop sizes noted previously. Without the turbulence produced by the movement of an object in close proximity to a printhead, the momentum of the ejected drops is adequate to keep the drops on their projected course so the registration of the drops from different printheads can be preserved for maintaining image quality. Additionally, the controller 124 can be configured with programmed instructions to operate the actuator 116 to move the object holder 120 at speeds that attenuate the air turbulence in the larger gap between the printhead and the surface of the object 122 used in the printing system 100.

Figure 4:
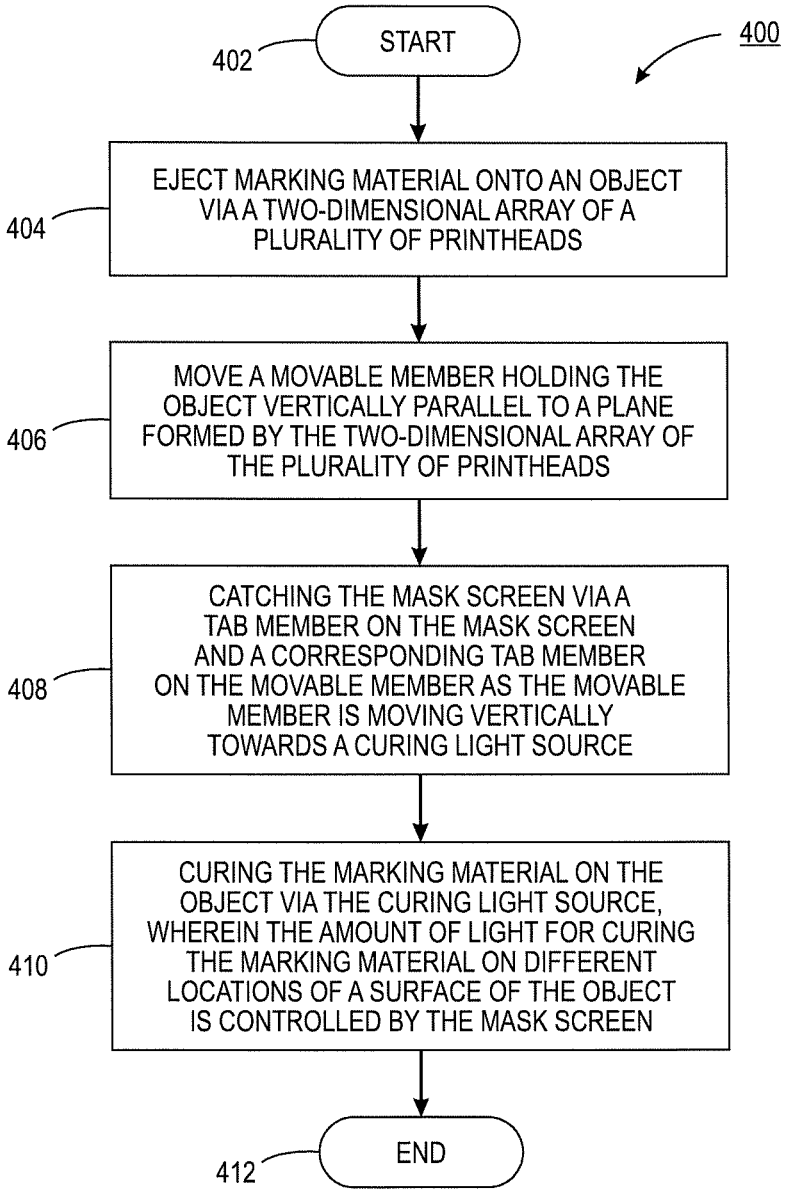
FIG. 4 illustrates a flowchart of an example method for curing marking material on an object using a mask screen.
Figure 5:
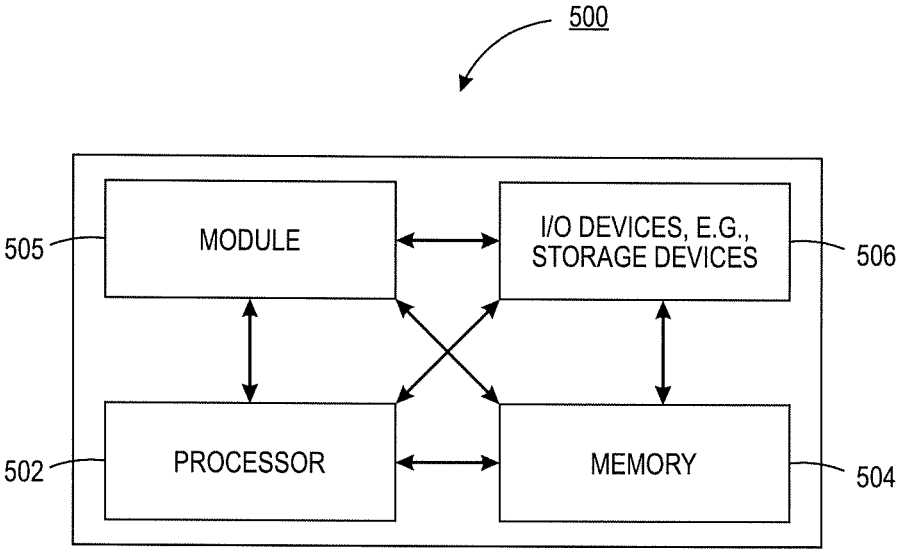
FIG. 5 illustrates a high-level block diagram of a computer suitable for use in performing the functions described herein.

FIG. 4 illustrates a flowchart of an example method 400 for curing marking material on an object using a mask screen. In one embodiment, one or more steps or operations of the method 400 may be performed by the printing system 100 or a computer that controls operation of the printing system 100 as illustrated in FIG. 5 and discussed below.

At block 402, the method 400 begins. At block 404, the method 400 ejects marking material onto an object via a two-dimensional array of a plurality of printheads. For example, the object may be moved vertically up and down along a support member via a movable member and object holder. The printheads may have different colors. The object may be moved in front of the printheads to receive the marking material that is ejected from the printheads according to a printing process or program that is executed by the controller.

At block 406, the method 400 moves a movable member holding the object vertically parallel to a plane formed by the two-dimensional array of the plurality of printheads. After the printing on the object is completed, the object may be moved to a curing station to cure the marking material. In one embodiment, the plane may be an imaginary surface to which each one of the plurality of printheads may be aligned. The object may move parallel to this plane vertically up and down.

At block 408, the method 400 catches a mask screen via a tab member on the mask screen and a corresponding tab member on the movable member as the movable member is moving vertically towards a curing light source. The corresponding tab member on the movable member may contact the tab member on the mask screen. As the movable member moves vertically towards the curing light source, the corresponding tab member may pull the mask screen vertically via the tab member of the mask screen.

The tab member and the corresponding tab member may be positioned to align the mask screen in front of the object. For example, the mask screen may comprise a plurality of light control areas. The mask screen may be a sheet metal with the light control areas comprising holes having different diameters or a glass with the light control areas having different levels of opaqueness, as described above. The different light control areas may be aligned to be in front of the proper areas of the surface of the object. In other words, the light control areas that allow more light may be aligned in front of locations on the surface of the object that are further away from the curing light source and the light control areas that allow less light may be aligned in front of locations on the surface of the object that are closer to the curing light source.

In one embodiment, each different object that can be printed on may have a pre-fabricated and customized mask screen. In one embodiment, a SKU or barcode may be read on the object that indicates which mask screen should be inserted into the printing system. The appropriate mask screen may be inserted into the printing system before printing of the object begins.

At block 410, the method 400 cures the marking material on the object via the curing light source, wherein the amount of light for curing the marking material on different locations of a surface of the object is controlled by the mask screen. In one embodiment, the mask screen may be located between the curing light source and the object. As noted above, the mask screen may have a plurality of light control areas. The plurality of light control areas may be different to control the amount of light that may pass through the mask screen and onto marking material that is ejected onto a surface of the object.

For example, when the mask screen is fabricated with sheet metal, the light control areas may be holes. The holes may have different sized diameters. The larger the diameter, the more light may be allowed to pass, and the smaller the diameter, the less light may be allowed to pass. The dimensions of the hole may vary and be a function of a distance of different locations of the surface of the object from the curing light source.

In another example, when the masks screen is fabricated from glass, or an optical clear material, the light control areas may be different levels of opaqueness in different areas of the mask screen. For example, less opaque areas may allow more light through and more opaque areas may allow less light through. The opaque areas may be a series of circles, or other shapes, along a surface of the glass. The amount of opaqueness for each area may be a function of a distance of different locations of the surface of the object from the curing light source.

In one embodiment, the mask screen may be vibrated horizontally as the mask screen and the object are moved past the curing light source. Vibrating the mask screen may allow even and complete curing over all locations on the surface of the object. For example, if the mask screen were static some areas of the surface of the object located behind the mask screen with no light control area may not receive any light from the curing light source for curing the marking material.

When the curing is completed, the movable member may move the object back vertically downwards away from the curing light source. The mask screen may return to a default position and be freed or separated from the movable member. The object may be removed and the printing processes may be repeated for another object. If a different object is used, the mask screen may be replaced with a different masks screen that is associated with the different object. At block 412, the method 400 ends.

It should be noted that the blocks in FIG. 4 that recite a determining operation or involve a decision do not necessarily require that both branches of the determining operation be practiced. In other words, one of the branches of the determining operation can be deemed as an optional step. In addition, one or more steps, blocks, functions or operations of the above described method 400 may comprise optional steps, or can be combined, separated, and/or performed in a different order from that described above, without departing from the example embodiments of the present disclosure.

FIG. 5 depicts a high-level block diagram of a computer that is dedicated to perform the functions described herein. As depicted in FIG. 5, the computer 500 comprises one or more hardware processor elements 502 (e.g., a central processing unit (CPU), a microprocessor, or a multi-core processor), a memory 504, e.g., random access memory (RAM) and/or read only memory (ROM), a module 505 for curing marking material on an object using a mask screen, and various input/output devices 506 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 505 for curing marking material on an object using a mask screen (e.g., a software program comprising computer-executable instructions) can be loaded into memory 504 and executed by hardware processor element 502 to implement the steps, functions or operations as discussed above in connection with the example method 400. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 505 for curing marking material on an object using a mask screen (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A print system, comprising:

a plurality of printheads arranged in a two-dimensional array, wherein each one of the plurality of printheads is configured to eject a marking material;

a curing light source coupled to the two-dimensional array of the plurality of printheads;

a movable member to hold an object and comprising a tab member on a bottom side of the movable member, wherein the movable member is positioned parallel to a plane formed by the two-dimensional array of the plurality of printheads and the curing light source;

a mask screen comprising a corresponding tab member configured to catch the tab member on the movable member, the mask screen positioned parallel to the plane, wherein the mask screen is movable to a location between the movable member and the curing light source; and a controller to control movement of the movable member to move the object past the array of printheads, to operate the plurality of printheads to eject the marking material onto the object as the object passes the two-dimensional array of printheads, to control movement of the movable member to catch the mask screen via the tab member on the movable member and the corresponding tab member on the mask screen and to operate the curing light source to cure the marking material, wherein the amount of energy that is applied to the object is controlled by the mask screen.

2. The print system of claim 1, wherein the mask screen comprises:

a left guide member;

a right guide member; and a stopping member, wherein the mask screen is positioned between the left guide member and the right guide member and the stopping member rests against a top of the left guide member and a top of the right guide member.

3. The print system of claim 2, wherein the stopping member is coupled to a top of the mask screen and positions the mask screen vertically above the movable member and vertically below the curing light source.

4. The print system of claim 2, wherein a return position comprises the stopping member resting against the top of the left guide member and the top of the right guide member.

5. The print system of claim 1, wherein the mask screen comprises a plurality of light control areas.

6. The print system of claim 5, wherein the mask screen comprises a metal and the plurality of light control areas comprises a plurality of holes.

7. The print system of claim 6, wherein the plurality of holes comprise different diameters based on a distance of a surface of the object from the mask screen.

8. The print system of claim 5, wherein the mask screen comprises an optically clear material and the light control areas comprise a plurality of different levels of opaqueness in different locations of the mask screen based on a distance of a surface of the object from the mask screen.

9. The print system of claim 8, wherein the optically clear material comprises a heat resistant plastic or glass.

10. The print system of claim 1, further comprising:

a mask screen vibrator that vibrates the mask screen horizontally as the mask screen and the object move past the curing light source.

11. A method for curing marking material on an object using a mask screen in a three dimensional (3D) object printer, comprising:

ejecting the marking material onto the object via a two-dimensional array of a plurality of printheads;

moving a movable member holding the object vertically parallel to a plane formed by the two-dimensional array of the plurality of printheads;

catching the mask screen via a tab member on the mask screen and a corresponding tab member on the movable member as the movable member is moving vertically towards a curing light source; and curing the marking material on the object via the curing light source, wherein the amount of light for curing the marking material on different locations of a surface of the object is controlled by the mask screen.

12. The method of claim 11, further comprising:

scanning a stock keeping unit (SKU) number of the object before printing; and inserting the mask screen that is prefabricated that corresponds to the SKU number into the 3D object printer.

13. The method of claim 11, further comprising:

vibrating the mask screen horizontally as the mask screen and the object are moved past the curing light source.

14. The method of claim 11, wherein the mask screen is located between the object and the curing light source.

15. The method of claim 11, wherein the mask screen comprises a metal and a plurality of holes, wherein the plurality of holes comprise different diameters based on a distance of a surface of the object from the mask screen.

16. The method of claim 15, wherein the mask screen comprises a glass with a plurality of different levels of opaqueness in different locations of the mask screen based on a distance of a surface of the object from the mask screen.

17. A print system, comprising:

a plurality of printheads arranged in a two-dimensional array, wherein each one of the plurality of printheads is configured to eject a marking material;

a curing light source coupled to the two-dimensional array of the plurality of printheads, wherein the curing light source comprises a two-dimensional array of light emitting diodes (LEDs);

a support member positioned to be parallel to a plane formed by the two-dimensional array of the plurality of printheads and the curing light source;

a member that is movably mounted to the support member and comprising a tab member on a bottom side of the member;

an actuator operatively connected to the member to enable the actuator to move the member along the support member;

an object holder, wherein the object holder is configured to mount to the member to enable the object holder to move an object in the object holder past the two-dimensional array of the plurality of printheads and the curing light source as the member moves along the support member;

a mask screen comprising a corresponding tab member configured to catch the tab member on the member, the mask screen positioned parallel to the plane, wherein the mask screen is movable to a location between the movable member and the curing light source; and a controller operatively connected to the plurality of printheads, the curing light source and the actuator, the controller being configured to operate the actuator to move the object holder past the array of printheads, to operate the plurality of printheads to eject the marking material onto an object held by the object holder as the object holder passes the two-dimensional array of printheads, to control movement of the member to catch the mask screen via the tab member on the member and the corresponding tab member on the mask screen and to operate the curing light source to cure the marking material, wherein the amount of energy that is applied to the object is controlled by the mask screen.

* * * * *